United States Patent [19]

Takeishi

[11] 4,051,637

[45] Oct. 4, 1977

[54] CYLINDER INTERNAL GRINDER

[76] Inventor: Norikazu Takeishi, 453, Nanjo, Nirayama-cho, Tagata, Shizuoka, Japan

[21] Appl. No.: 777,899

[22] Filed: Mar. 16, 1977

[51] Int. Cl.[2] ..... B24D 9/02

[52] U.S. Cl. ..... 51/364; 51/384; 51/386

[58] Field of Search ..... 51/330, 352–354, 51/359–361, 363, 372, 382–384, 386, 387, 364–369, 358

[56] References Cited

U.S. PATENT DOCUMENTS

| | | | |
|---|---|---|---|
| 2,657,506 | 11/1953 | Hadley | 51/353 |
| 2,856,738 | 10/1958 | Deuscale | 51/382 |
| 3,713,256 | 1/1973 | Besenbruch | 51/353 |

*Primary Examiner*—Al Lawrence Smith
*Assistant Examiner*—Nicholas P. Godici
*Attorney, Agent, or Firm*—Marshall & Yeasting

[57] ABSTRACT

An internal grinder for the cylindrical internal surfaces of machine parts that features the provision of a flexible wire secured to an end of the main shaft, a pair of holding elements erected centrally of a base member in opposition to each other, spring means erected at the opposed outer edges of said base member, pressing elements secured to the ends of said spring means and arranged parallel to the axis of said shaft, and a substantially M-shaped spring having its pressing portions inserted in the insides of said pressing elements and having its fixing portion fixed to an external edge of the grinding member such as sand paper. This device allows grinding of a cylinder in its axial direction even if other machine parts exist in such direction. It also allows continued use of the grinder in the event of wear of the grinding member by merely replacing such worn member. The device is also capable of performing grinding on a cylinder with a small inner diameter as well as grinding of not only a part made of a hard material such as steel but also a soft or flexible part made of a soft material such as aluminum.

5 Claims, 4 Drawing Figures

CYLINDER INTERNAL GRINDER

BACKGROUND OF THE INVENTION

1. Field of the Invention

This invention relates to a novel grinding device which is capable of easily grinding the cylindrical internal surfaces of a wide variety of machine parts.

2. Description of the Prior Arts

It is ordained by law that the internal faces of the master and wheel cylinders used in the hydraulic brake system in an automobile or other machines should be subjected to re-grinding at the time of a periodical checkup. Heretofore, such re-grinding of the internal faces of the master and wheel cylinders in the hydraulic brake system for an automobile, etc., has been accomplished by the manual work with a sand paper. This method, however, has the defects that it is difficult with such method to uniformly grind the cylindrical internal face and that a long time is required for such grinding work.

As an alternative method for grinding the master and wheel cylinders used in the hydraulic brake system for an automobile, etc., there is known a method in which rotatory force is given by a motor-driven drill or other means to a small-sized honing horn using oil-stone and such oil-stone is pressed against the cylindrical internal face of the work by the centrifugal force. But this method has a disadvantage that it is useless for grinding on a work with a small inner diameter as it is impossible to insert the honing horn composed of plural pieces of oil-stone into the cylinder. Also, in case of using such small-sized honing horn, even if it is possible to insert the honing horn into the cylindrical work to perform desired grinding, it is impossible to replace the oil-stone alone and hence it needs to replace the entire honing horn upon wear of the oil-stone, resulting in elevated working cost. Further, in use of such small-sized honing horn, it is impossible to insert the grinder into the cylinder to be worked if other machine parts or devices are present in the axial direction of the cylinder and hence, in such a case, no grinding work can be performed. Moreover, in case the master and wheel cylinders used in the hydraulic brake system for automobiles, etc., are made of a soft material such as aluminum as often practiced in the industry of late, use of such honing horn proves quite ineffective for grinding on such parts.

SUMMARY OF THE INVENTION

The present invention is designed to overcome these defects of the conventional grinding devices, and accordingly it is an object of this invention to realize an internal grinder which is capable of accomplishing the desired grinding operation on a cylinder even if other machine parts or elements are present in the axial direction of the cylinder.

Another object of this invention is to realize a grinder which has no need of replacing the entire grinder assembly even if the grinding member has worn off in use; the grinder assembly can be used continuously by merely replacing the worn-off grinding member alone.

Still another object of this invention is to provide a grinder which is capable of accomplishing the grinding work on a cylinder with a small inner diameter by inserting the grinder into the cylinder to be worked.

It is an additional object of this invention to realize a grinder whereby it is possible to perform grinding, with ease, not only on a cylinder made of a hard material such as steel but also on a cylinder made of a soft material such as aluminum by merely changing the grinding member.

DESCRIPTION OF THE PREFERRED EMBODIMENTS

Figure 1:
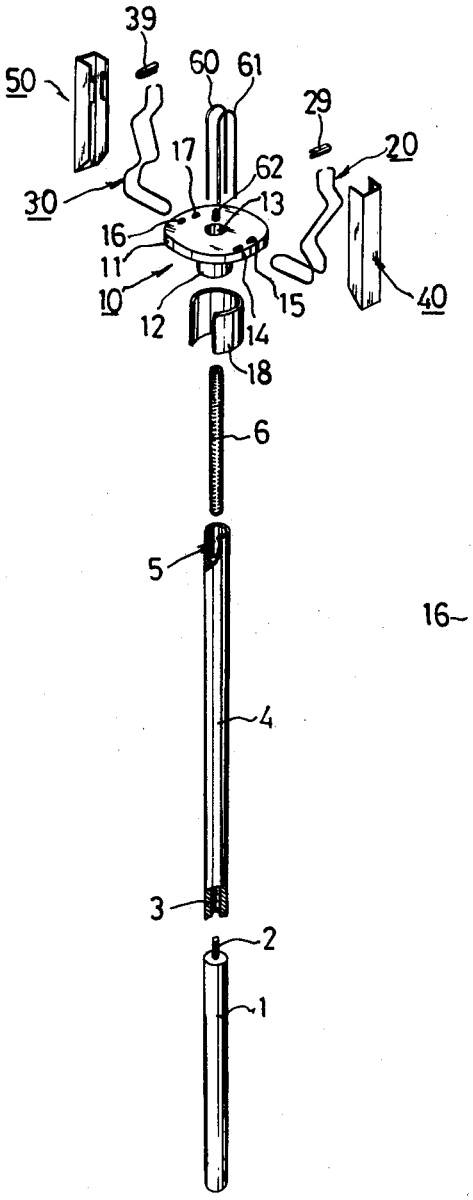
FIG. 1 is an exploded perspective view of a grinder according to the present invention, with parts cut away.
Figure 2:
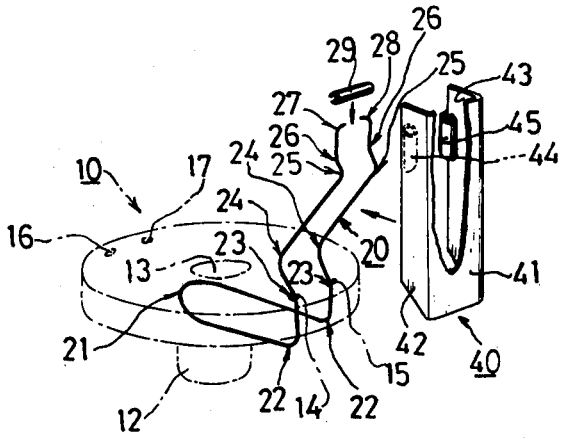
FIG. 2 is an enlarged perspective view for illustrating a mode of assemblage of spring means to a base.
Figure 3:
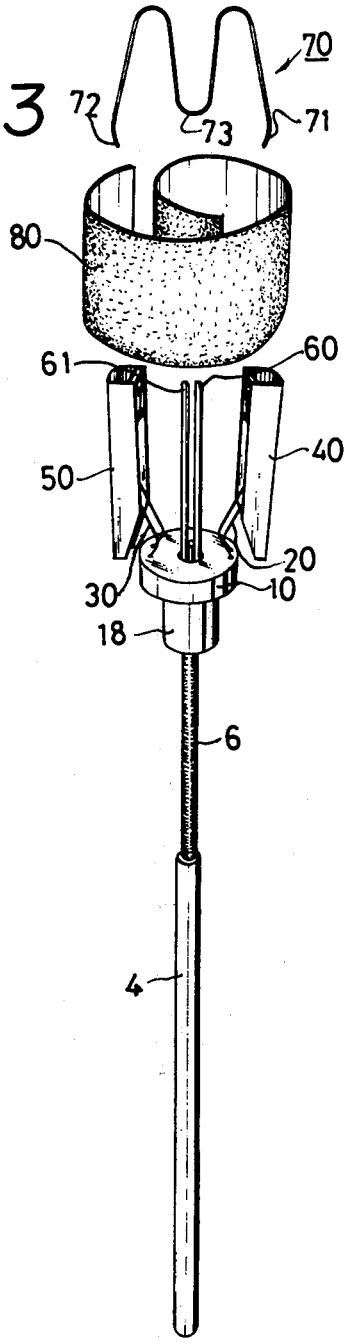
FIG. 3 is a perspective view illustrating the assemblage of the grinder according to this invention.
Figure 4:
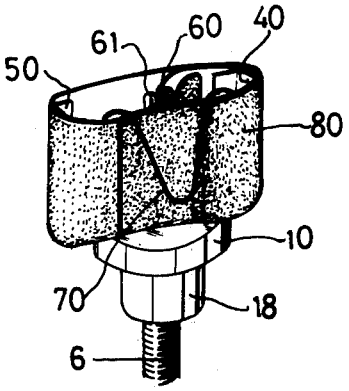
FIG. 4 is a partial perspective view of a grinder having a grinding member set in position.

The present invention is now described in detail by way of some embodiments thereof with reference to the accompanying drawings. Discussed first is a method of assembling a grinder according to an embodiment of this invention.

It will be seen that a base 10 of the device is provided with a pair of holding elements 60, 61 and spring means 20, 30 adapted to elastically hold the respective pressing elements 40, 50 for mounting a grinding member, and a flexible wire 6 is connected to the base 10. This base 10 is made from bar stock by lathing so as to have a flange 11, a boss 12 and a central hole 13. The flange 11 is formed with holes 14, 15, 16, 17 for fixing therein the respective spring means 20, 30 adapted for elastically support the pressing elements 40, 50.

Spring means 20, 30 are mounted to the base 10 in the following way. First, the spring member 20 is bent at its middle point to form a U-shaped portion 21 so as to encompass the boss 12 of the base 10, and then the first orthogonal bends 22 are formed and inserted into the corresponding holes 14, 15. Then the second bends 23 are formed with an inclination of about 15° inwardly above the upper surface of the flange 11, and then the third bends 24 are formed with an inclination of about 120° outwardly. The spring is further bent inwardly at the points 25 (fourth bends) which abut against the inside of the pressing member 40, and then further bent at the points 26 (fifth bends) for providing the portions for securing the pressing element 40. These portions extend parallel to the axis of the base 10. Then the ends of the spring 20 are bent to form the sixth bend 27 and seventh bend 20 so that the bend ends are opposed to each other, and these bent ends are fitted in a substantially U-sectioned pin 29 which is caulked and secured to said bent spring ends. The other spring member 30 is also similarly bent and secured to the base 10.

For adapting the holding elements 60, 61 to the base 10, the middle part of each element is bent to form an inverted U-shape and the lower ends are pressed into the central hole 13 in the base 10 by using an inserting rod 62 as a pivot.

The flexible wire 6 is coiled in the same direction as the direction of rotation of the grinder, and its end is inserted into the central hole 13 of the base 10 and secured to the base 10 by caulking the outer periphery of the boss 12. A collar 18 is press-fitted to the boss 12 to fix the springs 20, 30 in position.

The pressing elements 40, 50 are mounted to the respective spring means 20, 30 secured to the base 10 in the following way. Discussing first about the pressing element 40, this element 40 is provided with substantially vertical erect portions 42, 43 on both sides of an arcuate pressing portion 41, and toward the upper ends of said erect portions 42, 43 are provided substantially U-shaped fixing portions 44, 45 to which the end portions of the spring 20 are secured. The spring portions that extend parallel to the axis of the base 10 from the fifth bent portions 26 are passed through said fixing portions 44, 45 of the pressing element 40 and, after caulking, they are soldered and fixed in position. In this way, the pressing element 40 is securely fixed in position parallel to the axis of the grinder. Another pressing element 50 is also likewise secured to the spring member 30 by similarly arranging the pressing portion 51, erect portions 52, 53 and fixing portions 54, 55.

As for securing of the lower end of the flexible wire 6 to the shaft 4, said shaft 4 is provided at its top end a hole 5 which is slightly greater than the outer diameter of the flexible wire 6, and the lower end of the flexible wire 6 is inserted into said hole 5 and caulked from the outer periphery of the shaft 6 to fix the flexible wire 6 and shaft 4 coaxially with each other.

When providing an extension 1 coaxially with the shaft 4, an internal thread 3 is provided on the rear end portion of the shaft 4 while a corresponding external thread 2 is formed at the top end of the extension shaft 1, and said both threads are engaged with each other to connect the shaft 4 and extension 1.

In use of the grinder according to this invention, a sheet-shaped grinding member, for example an oil-resistant sand paper 80, is wrapped around the pressing elements 40, 50 in the same direction as the direction of rotation of the grinder by coiling and fixing an end of the sand paper between the holding elements 60, 61. When winding the oil-resistant sand paper 80 around the pressing elements 40, 50, it should be noted that the paper is wound up against the elastic force of spring means 20, 30 such that the roll diameter will be slightly greater than the inner diameter of the cylinder to be worked. With the oil-resistant sand paper 80 being thus wound up in position, the pressing portions 71, 72 of the substantially M-shaped spring 70 are inserted into the rear sides of the respective arcuate pressing portions 41, 51 of the pressing elements 20, 30, and the fixing portion of said spring 70 is so positioned as to press against the external peripheral face of the wound-up oil-resistant sand paper 80 to fix the terminal end of the oil-resistant sand paper 80 in position. In this way, the oil-resistant sand paper 80 is securely fixed to the pressing elements 40, 50, and it is now possible to uniformly grind the internal surface of the cylinder with the oil-resistant sand paper 80 surrounding the pressing portions 41, 51 of the pressing elements 40, 50 by giving an outward pressing force to the lower portions of said pressing elements 40, 50. The rear end of the shaft 4 is joined to a motor-driven drill or clamped by lathe chucks to give a rotatory force to the shaft 4, and the oil-resistant sand paper 80 is placed into the cylinder to perform the desired grinding work on said cylinder.

When the surface portion of the oil-resistant sand paper 80 that corresponds to the pressing portions 41, 51 of the pressing elements 40, 50 has become worn, the M-shaped spring 70 is removed and the sand paper 80 is slightly displaced and re-wound so that grinding will be performed by the non-used portion of the sand paper 80. When all the surface area of the sand paper 80 has been used, it is replaced with a new oil-resistant sand paper. The new sand paper is set in position on the pressing elements 40, 50 in the same way as described above.

In case the cylinder to be worked is made of a soft material such as aluminum, a cloth 81 is wound around the pressing elements 40, 50 in the same way as in the case of the oil-resistant sand paper 80 and then a compound is spread on said cloth 81.

In case there exists other machine part, element, etc., in the axial direction of the cylinder to be worked, the flexible wire 6 may be bent to avoid such obstacle. If no required rotatory force is provided by the shaft 4 alone, the shaft 4 may be provided with an extension 1 to allow normal use of the grinder.

What is claimed is:

1. A cylinder internal grinder comprising a shaft provided with rotary force at one end thereof, a flexible wire secured to the other end of said shaft, a base secured to said flexible wire, a pair of holding elements erected centrally of said base in opposition to each other, spring means erected at the opposed edges of said base, pressing elements secured to the ends of said spring means and arranged parallel to the axis of said shaft, a grinding member having its one end secured to said holding elements and arranged to wrap the pressing elements in the direction opposite to the direction of rotation of said shaft, and a substantially M-shaped spring having its pressing portions inserted in the insides of said pressing elements and having its fixing portion fixed to an external edge of said grinding member.

2. A cylinder internal grinder as set forth in claim 1, wherein said shaft is provided with an extension coaxially therewith.

3. A cylinder internal grinder as set forth in claim 1, wherein two parallel piano wires are used as spring means.

4. A cylinder internal grinder as set forth in claim 1, wherein an oil-resistant sand paper is used as grinding member.

5. A cylinder internal grinder as set forth in claim 1, wherein a cloth coated with a compound is used as grinding member.

* * * * *